United States Patent [19]

Schönmeier et al.

[11] Patent Number: 4,805,847

[45] Date of Patent: Feb. 21, 1989

[54] APPARATUS FOR TREATING A WEB OF CONTINUOUS MATERIAL

[75] Inventors: Herbert Schönmeier, Düsseldorf; Reinhard Hehner, Haan, both of Fed. Rep. of Germany

[73] Assignee: Jagenberg AG, Dusseldorf, Fed. Rep. of Germany

[21] Appl. No.: 173,730

[22] Filed: Mar. 25, 1988

[30] Foreign Application Priority Data

Mar. 30, 1987 [DE] Fed. Rep. of Germany ..... 3710039

[51] Int. Cl.[4] ..... B65H 23/04

[52] U.S. Cl. ..... 242/56.2; 242/67.2; 226/92

[58] Field of Search ..... 242/55, 56 R, 56.2, 242/56.4, 56.9, 65, 66, 67.1 R, 67.2, 74, 195; 226/91, 92

[56] References Cited

U.S. PATENT DOCUMENTS 2,944,345 7/1960 Faeber ..... 226/92 X

*Primary Examiner*—David Werner

*Attorney, Agent, or Firm*—Herbert Dubno

[57] ABSTRACT

A device for threading a web of flexible material through the array of rollers of a machine, e.g. a coiler for the web, utilizes an endless guide wire guided over deflection rolls integrated with those web-guide rolls which are located along the underside of the web. The wire-deflection rolls associated with the web-guide rolls along the upper surface of the web are spaced therefrom and have means cooperating with the kite wire attaching the leading end of the web to the guide wire for deflecting the kite wire off these deflecting rolls so that the deflecting rolls can be located centrally of the web-guide path.

12 Claims, 3 Drawing Sheets

APPARATUS FOR TREATING A WEB OF CONTINUOUS MATERIAL

FIELD OF THE INVENTION

Our present invention relates to an apparatus for treating a web of flexible material, e.g. a paper web, and more particularly, to a device for feeding a web of flexible material centrally along a path in a web-processing machine such as a rolling, slitting or like apparatus.

In the processing of continuous webs of material, for example, paper and particularly for the rolling of the web into rolls or coils and/or in the longitudinal slitting of a web into a plurality of narrower strips, it is necessary to feed the web in the machine and, for this purpose, the feed path is defined by a plurality of web-guide rolls which can be located above and below the web and around which the web can pass in at least tangential contact. To draw the web into the machine and along the path, a guide wire or cable can be provided which is displaceable along the path and passes along a plurality of wire-deflection rolls.

The web can have its leading end connected to the guide wire by a so-called kite wire, i.e. a wire which is attached to the guide wire and draws the web along in the same manner as a kite may be pulled by a kite string.

In the drawing of a web of flexible material into a machine, for example, a rolling machine for winding up or coiling the web in one or more rolls, a variety of approaches have been used and practically all of these earlier approaches involve one or another problem and/or is labor intensive.

For example, it is known to feed strip ends or strip swings into the machine at the leading end of a web by the use of service personnel who must assist the feed at a number of locations.

In modern rolling machines for winding up a web into a roll, the feed path is located in a basement of the plant below the floor on which the main elements of the coiler are located. It is, therefore, difficult to provide access to the path by assisting personnel and the problem is made all the more difficult because of the variety of strip ends and strip swings which are used and must be attended to.

In another approach to the drawing of the web into the processing machine, a guide cable is passed over deflection rolls which is disposed laterally of the web-guide rolls. The leading end of the web is then attached to the kite cable which has its end remote from the web affixed to the guide cable which extends in a path parallel to the desired path of the web. The web is then pulled into position in the guide rolls while the kite cable runs off to a side in an inclined manner.

The act of drawing the web along the web-guide rolls, utilizing such a kite cable, of necessity means that a force component will be exerted on the web to the side, tending to pull the web out of its central position. To minimize this effect, it has been necessary in the past to operate with very long kite cables.

After connection of the leading end of the web to the kite cable, the latter may then have to be wound up on the web roll from which the web is uncoiled and the entire process, therefore, is very time-consuming in the operation of the coiler.

Even the use of relatively long kite cable attachments of the web to the laterally disposed guide cable pose problems.

OBJECTS OF THE INVENTION

It is the principal object of the present invention to provide an apparatus of the aforedescribed type which can provide a rapid feed of a web of material generally centrally along its path without manual intervention.

Another object of this invention is to provide an improved device for feeding a web of a flexible material centrally along a path in a web-processing machine so that the drawbacks of earlier systems as described above can be obviated.

SUMMARY OF THE INVENTION

These objects are attained, in accordance with the invention in a device for feeding a web of a flexible material centrally along a path in a web-processing machine, comprising:

a plurality of upper web-guide rolls engageable with a web of flexible sheet material from above and a plurality of lower web-guide rolls engageable with the web from below and disposed between the upper web-guide rolls along a path of the web from an inlet side of the path to an outlet side thereof;

a respective first wire-deflection roll disposed axially substantially midway along each of the lower web-guide rolls and provided with a circumferential wire-receiving wire guide;

a respective second wire-deflection roll spaced radially below and juxtaposed with each upper web-guide roll whereby the web can pass between each second wire-deflection roll and the respective upper web-guide roll, each second wire-deflection roll being provided with a circumferential wire-receiving wire guide;

a guide wire lying in the wire guides and running in the wire-deflection rolls to alternately pass over and under same along the path and generally centrally thereof, the guide wire being driven to draw the web along the path;

a kite wire affixed centrally to a leading end of the web and attached to the guide wire for drawing the web into contact with successive ones of the web-guide rolls along the path as the guide wire is driven; and cooperating means for laterally deflecting the kite wire out of the wire guide of each second wire-deflection roll as the leading end approaches the respective upper web-guide roll to ensure substantially central positioning of the web along the path.

More specifically, the displacement of the web-guide cable or wire in the central region of the web-guide rolls is effected in such manner that for the lower web-guide rolls along the path, the wire is guided in a groove disposed centrally of the respective roll.

However, for the upper rolls along the path, i.e. the rolls located above the web, associated wire-deflection rolls are provided on the sides of these rolls over which the web passes (i.e. the web-guiding sides) but with a radial distance from these upper web guiding rolls and centrally thereof while each upper deflection roll along the path is formed with means for laterally deflecting the kite wire or cable from the deflection roll over which it passes.

With the system of the invention, the guide wire or cable is centrally located along the path and thus draws the web centrally through the array of upper and lower web-guide rolls. Because the kite wire or cable as it passes each deflection roll associated with each upper web-guide roll is provided with means for releasing the kite wire as the guide wire undershoots this deflection roll, the kite wire can jump past these deflection rolls and permit its connection to the leading end of the web to travel along the web path against the respective upper web-guide roll.

This ensures a central positioning of the web at all times.

Because the kite wire and hence the leading end of the web is never pulled from a side, long kite wires are unnecessary and can be eliminated.

The problem which might otherwise be expected to arise because the guide planes for the web and the guide wire can cross is eliminated by laterally deflecting the kite wire as the guide wire undershoots the deflection rolls which are associated with the upper web-guide rolls. The web of material, therefore, will always remain on the same side of the guide wire or cable.

To laterally cast the kite wire off of each wire-deflection roll associated with a web-guide roll along the upper side of the web, according to one embodiment of the invention, the guide means of each such deflection roll can be provided so that it only provides a lateral guide for the guide cable while the kite wire is free from lateral guidance and can slide off this deflection roll at least from one side.

The casting off of the kite wire can be effected by providing a leading portion of the kite wire with an enlargement preferably in the form of a ball, while each deflection roll radially spaced from but associated with each upper web-guide roll has a deflecting element which engages this ball and shifts it to a side. Advantageously the deflection element is an annular flange.

The kite wire, therefore, will normally run together with the guide wire around each deflection roll associated with an upper web-guide roll. As the leading end of the web approaches the latter, however, the reaction between the flange and the ball is such to release the leading end and permit it to jump centrally along the underside of the respective upper guide roll.

The reaction to the casting off of the kite wire by the deflection rolls can be a rearward shock to stress the leading end of the web which is drawn into the machine. To avoid this backward stressing or reduce it, according to another feature of the invention, the kite wire or cable is resilient or elastic in its longitudinal direction, i.e. over this length. This longitudinal segment of the kite wire can be provided with a spring and with respect to the direction in which the web is drawn into the machine, this elastic length segment can lie behind the thickening.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
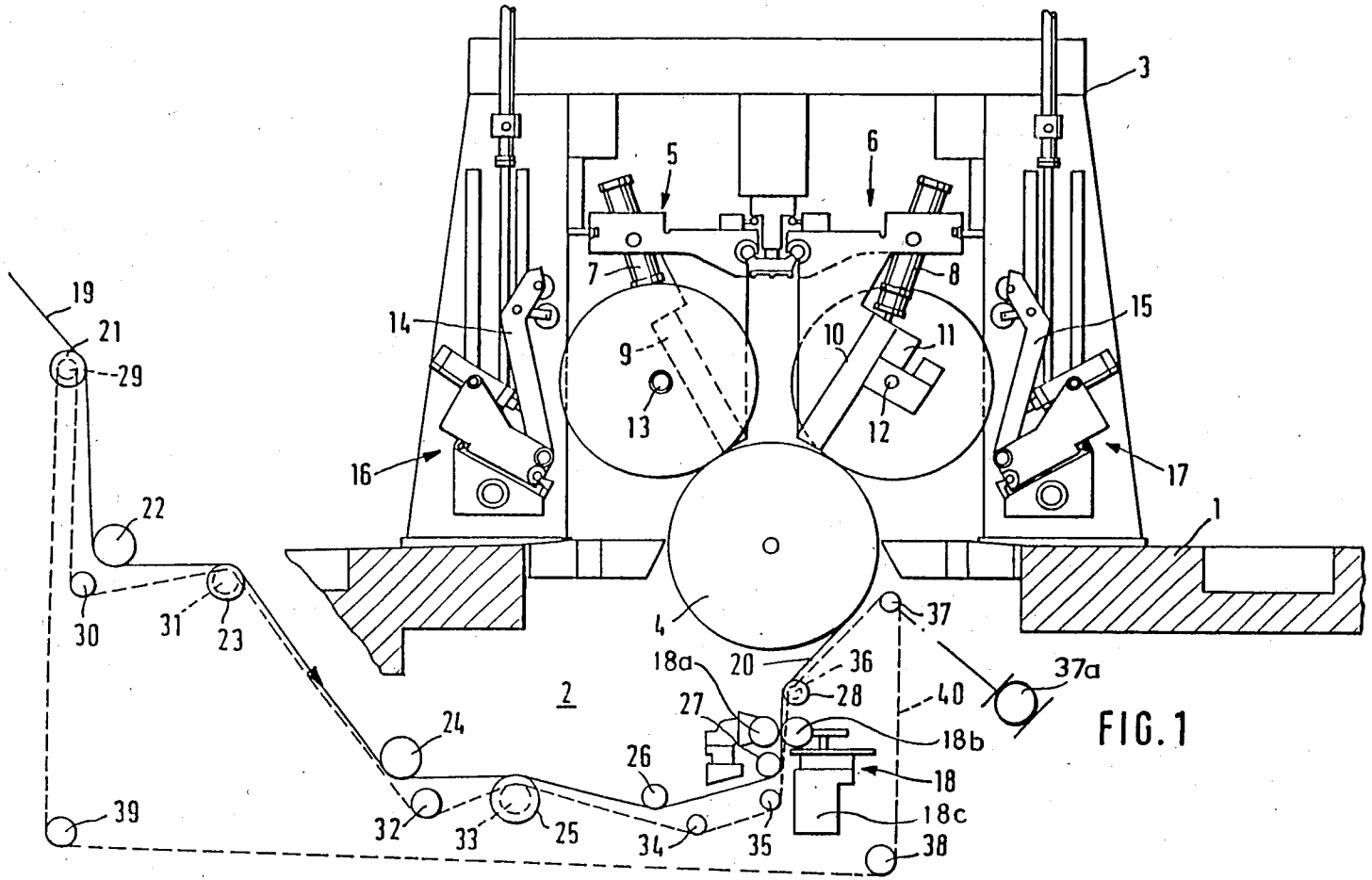
FIG. 1 is a diagrammatic side cross-sectional view showing a coiling machine for coiling a multiplicity of strips slit from a continuous web in accordance with the invention.

From the drawing it can be seen that a floor 1 lies above a cellar or basement 2 of a plant in which a roller machine for the coiling of strips of a web material is received. The roller or coiler comprises a frame 3 mounted above the floor 1 and in which a support roll 4 is journaled.

Two coiling stations 5 and 6 cooperate with the support roll 4. Each coiling station 5, 6 has a guide 9, 10 which supports a carriage 11 shiftable along the guide and carrying a mandrel 12 upon which a coiling sleeve 13 may be threaded. A motor drive 7, 8 is provided for rotating the mandrel and displacing the carriage and swingable arms 14 and 15 of coiler accessory units 16 and 17 can be provided to assist in winding the web or strip selectively onto the respective coiling sleeve.

In practice, the web or a set of strips subdivided from the web transversely by longitudinal slitters is pressed against the respective sleeve by rollers at the ends of one of the arms 14, 15 and is caused to adhere to the sleeve. As the support roller 4 rotates and the sleeve counterrotates while resting against the roller 4, the web or strip is coiled on the sleeve until the roll of web material is fully wound, whereupon the web can be cut and shifted to wind onto the sleeve of the other winding station while the full rolls are transported away and new sleeves placed on the respective mandrel. As the rolls increase in diameter, the mandrel thereof is shifted along the respective guide 9 or 10 by the drives 7, 8.

A coiler of this type is generally known in the art and represents one type of machine to which the web may be fed utilizing the web feed means capable of threading the web between and around upper and lower rolls in the manner to be described.

In the cellar 2 below the support roll 4, the machine can be provided with longitudinal shears 18 which can slit the web into a plurality of longitudinal strips 20 alternately wound upon the sleeves 13 of one station 5 and then the sleeves 13 of the other station 6. The slitter can be formed by a pair of shear blades **18*a* or 8*b* for each slit, driven by a motor 18*c***.

The web 19 of the material is fed to the roll 4 from the left (FIG. 1) and passes along the web-guide path into contact with web-guide rolls 21–28 located against the underside of the web or along the upper side thereof so that the rolls 21, 23, 25 and 28 can be termed lower web-guide rolls whereas the rolls 22, 24, 26 and 27 can be termed upper guide rolls. The web 19 is drawn through and threaded into this set of rolls by a device for feeding the web in accordance with the invention.

The device for feeding the web comprises a plurality of wire-deflection rolls 29–39 over which the endless guide wire 40 passes, the guide wire being driven in the material-feed direction, i.e. to the right in the upper pass of this endless path, by a motor **37*a* connected to a deflection roll 37**.

Figure 4:
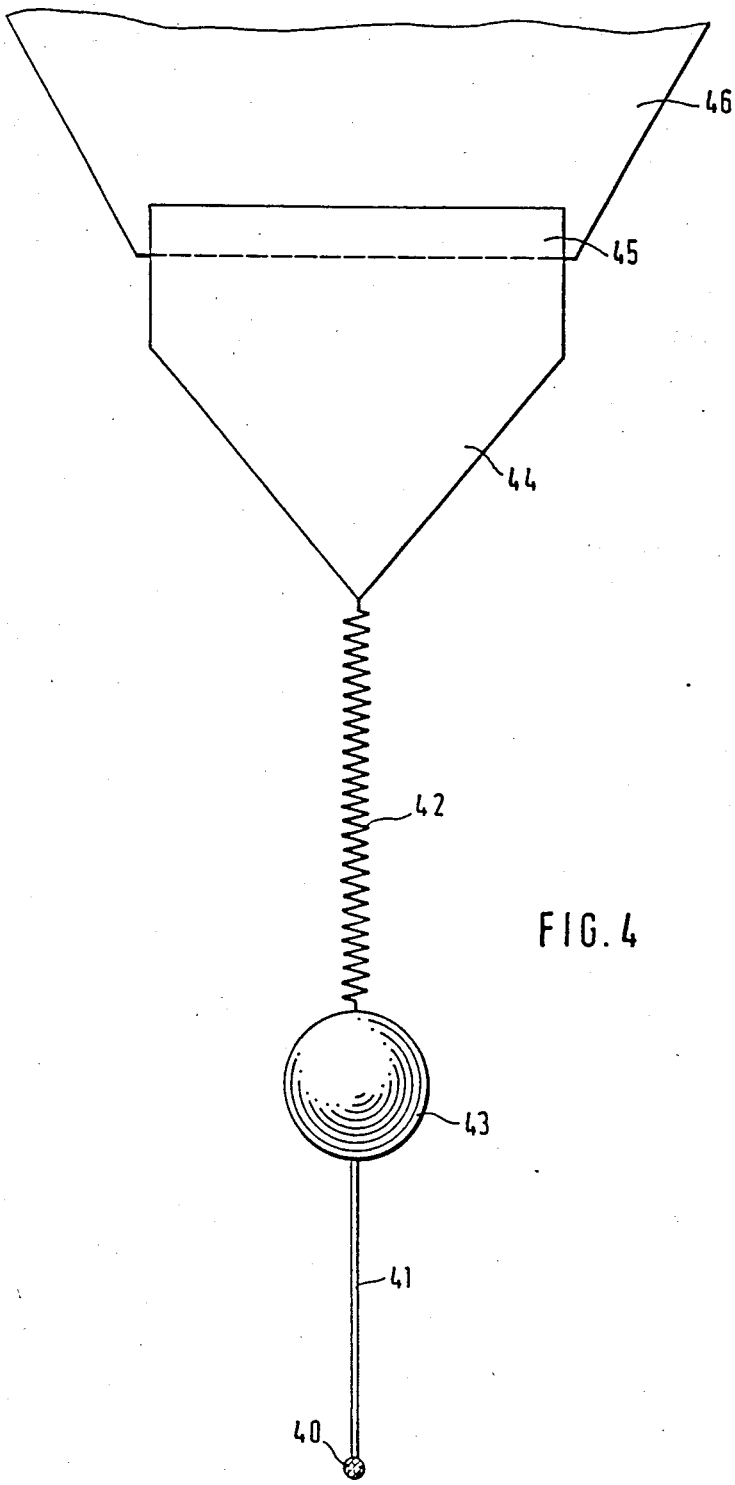
FIG. 4 is a plan view diagrammatically showing the relationship between the leading end of the web, the guide wire and the kite wire in accordance with the invention.

To the guide cable or wire 20, a "kite" wire is attached as can be seen from FIG. 4.

The kite wire has a first portion (as seen in the longitudinal direction) which is substantially inextensible and is designated by the reference numeral 41 in this Figure. The inextensible portion 41 of the kite wire if followed by a longitudinal elastic and yieldable portion 42 shown as a spring and between the two portions 41 and 42, the kite wire is provided with a thickened portion in the form of a ball 43.

The kite wire as thus constituted is connected to a so-called "kite" 44 which may be of fabric, paper or the like and has generally a kite shape, being centrally connected to the leading end 46 of the web to be drawn into the machine by an adhesive strip 45.

The deflection rolls 29–39 on which the guide wire 40 passes in its endless travel are located centrally of the web path.

The wire-guide rolls 29, 31, 33 and 36 which are associated with the web-guide rolls 21, 23, 25, 28 engaging the underside of the web, are respectively integrated in these web-guide rolls.

Figure 2:
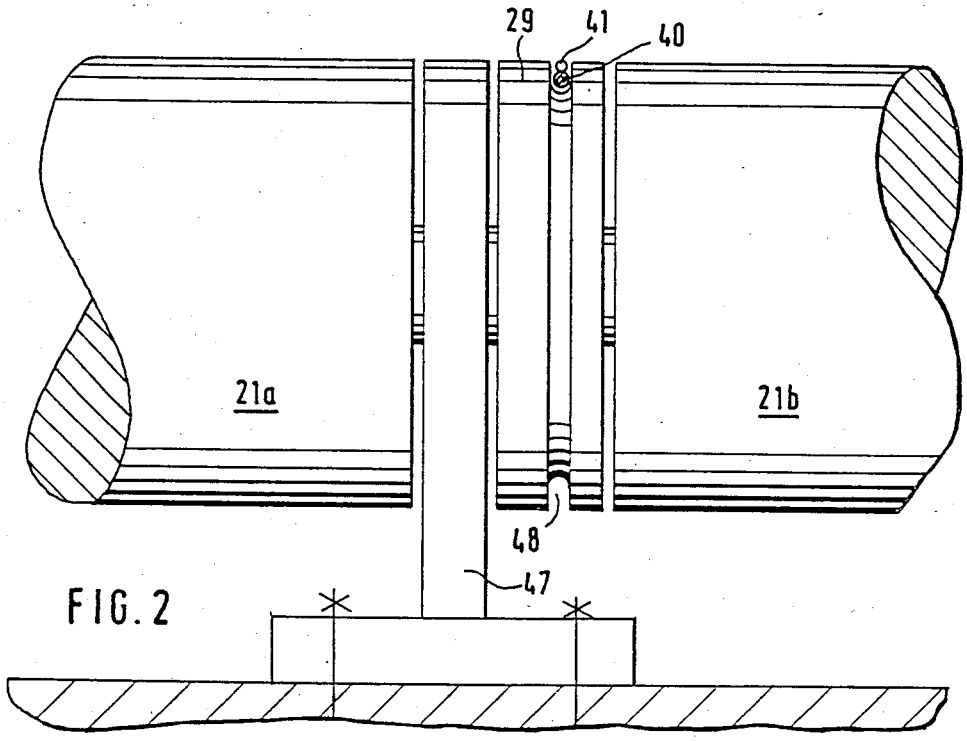
FIG. 2 is a plan view showing a web-guide roll having a wire deflecting roll integrated therewith as is used for the lower web-guide rolls along the web path.

This integrated structure is visible from FIG. 2.

Between two segments 21*a* and 21*b* of the centrally divided web-guide roll 21, a journal 47 is provided together with a wire-deflection roll 29. The other web-guide rolls 23, 25 and 28 are similarly constructed with respective deflection rolls 31, 33 and 36.

Each of these deflection rolls 29 corresponds in radial dimension to that of the respective web-guide roll 21. Each of these deflection rolls, moreover, is provided along this circumference with an annular groove 48 dimensioned to accommodate both the guide wire 40 and the inextensible segment 41 of the kite wire. Since the deflection rolls 29, 31, 33 and 36 are adjacent the central journal 47 and in the central split between the segments 21*a*, 21*b*, for example, the ball 43 also is guided in the central region without danger of lateral dislocation.

Figure 3:
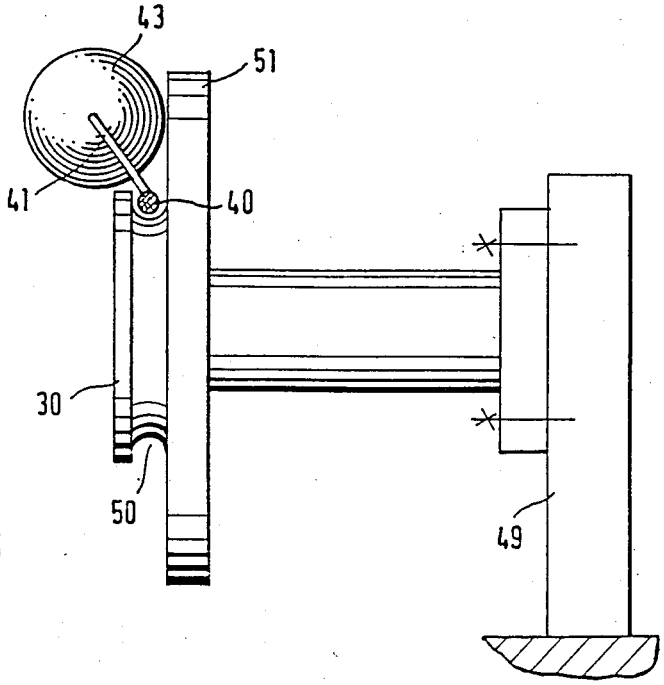
FIG. 3 is an elevational view of a wire-deflection roll radially offset from an upper web-guide roll according to the invention, illustrating the means for casting off a kite wire in accordance with the invention, the deflection roll being inverted from its normal position in which the guide wire undershoots the deflection roll.

By contrast, the wire-deflection rolls 30, 32, 34 and 35 which are associated with the web-guide rolls 22, 24, 26, 27 engaging the upper side of the web 19, are offset therefrom radially below the web as shown and are journaled in independent bearing units 49 as has been illustrated, for example, in FIG. 3 (although inverted) for the deflection roll 30.

In the periphery of the deflection roll 30, a guide groove 50 is provided which is dimensioned to at least receive the guide cable 40 and preferably to receive only the guide cable 40 and not the kite segment 41.

The deflection roll 30 is formed on one side with annular flange 51 which constitutes a cast-off means cooperating with the ball 43 to deflect the kite wire laterally off the deflection roll 30 and permit it to move toward the surface of the juxtaposed web-guide roll 22. In this manner, a crossing of the leading end of the web with the guide cable 40 can be avoided in spite of the arrangement of the guide cable centrally of the path of the web and below the web-guide rolls 22, 24, 26, 27 which engage the web from above.

We claim:

1. A device for feeding a web of a flexible material centrally along a path in a web-processing machine, comprising:

a plurality of upper web-guide rolls engageable with a web of flexible sheet material from above and a plurality of lower web-guide rolls engageable with said web from below and disposed between said upper web-guide rolls along a path of said web from an inlet side of said path to an outlet side thereof;

a respective first wire-deflection roll disposed axially substantially midway along each of said lower web-guide rolls and provided with a circumferential wire-receiving wire guide;

a respective second wire-deflection roll spaced radially below and juxtaposed with each upper web-guide roll whereby said web can pass between each second wire-deflection roll and the respective upper web-guide roll, each second wire-deflection roll being provided with a circumferential wire-receiving wire guide;

a guide wire lying in said wire guides and running in said wire-deflection rolls to alternately pass over and under same along said path and generally centrally thereof, said guide wire being driven to draw said web along said path;

a kite wire affixed centrally to a leading end of said web and attached to said guide wire for drawing said web into contact with successive ones of said web-guide rolls along said path as said guide wire is driven; and cooperating means for laterally deflecting said kite wire out of the wire guide of each second wire-deflection roll as said leading end approaches the respective upper web-guide roll to ensure substantially central positioning of said web along said path.

2. The device defined in claim 1 wherein each of said second wire-deflection rolls has a wire exclusively guiding the respective guide wire laterally and leaving the kite wire laterally unguided.

3. The device defined in claim 1 wherein said cooperating means includes a thickened portion on said kite wire.

4. The device defined in claim 3 wherein said thickened portion is a ball.

5. The device defined in claim 4 wherein each of said second wire-guide rolls has a deflecting portion cooperating with said ball for laterally deflecting said kite wire.

6. The device defined in claim 5 wherein said deflecting portion is an annular flange.

7. The device defined in claim 6 wherein said kite wire is longitudinally elastic.

8. The device defined in claim 7 wherein said kite wire has an elastic portion between said ball and a kite adhesively affixed to said leading end, and a substantially inelastic portion connecting said ball to said guide wire.

9. The device defined in claim 8 wherein said upper web-guide rolls alternate with said lower web-guide rolls.

10. The device defined in claim 9 wherein said machine is a web coiler provided with a roller over which said web passes onto a coiling tube at said outlet side of said path.

11. The device defined in claim 10, further comprising a longitudinal slicer slicing said web into a plurality of strips at said outlet end of said path.

12. The device defined in claim 11 wherein said guide wire is guided by additional deflection rolls along an endless path, one of said additional deflection rolls being driven to drive said guide wire.

* * * * *